US005090707A

United States Patent [19]

Patz

[11] Patent Number: 5,090,707

[45] Date of Patent: Feb. 25, 1992

[54] CARD GAME SIMULATING THE SPORT OF HUNTING

[75] Inventor: Darrell Patz, Coleman, Wis.

[73] Assignee: Reflect Game Corp., Green Bay, Wis.

[21] Appl. No.: 663,252

[22] Filed: Mar. 1, 1991

[51] Int. Cl.[5] ..... A63F 1/00

[52] U.S. Cl. ..... 273/298; 273/308

[58] Field of Search ..... 273/298, 308, 303-306

[56] References Cited

U.S. PATENT DOCUMENTS 2,072,799 3/1937 Creswell ..... 273/308

FOREIGN PATENT DOCUMENTS 1015549 10/1952 France ..... 273/308

*Primary Examiner*—Benjamin Layno

*Attorney, Agent, or Firm*—Andrus, Sceales, Starke & Sawall

[57] ABSTRACT

A card game simulating the sport of hunting includes a deck of cards having indicia printed on the face of each card and including wild game cards that indicate the type of animal being hunted, shot cards that indicate the number of shots a hunter may take, problem cards that indicate difficult situations that may be encountered by a hunter and remedy cards that eliminate the problem cards.

15 Claims, 3 Drawing Sheets

CARD GAME SIMULATING THE SPORT OF HUNTING

BACKGROUND OF THE INVENTION

The present invention relates to a card game and more specifically to a card game that simulates the sport of deer hunting. Hunting, and more specifically deer hunting, is a popular sport throughout North America. However, due to hunting restrictions, the sport can only be enjoyed for a limited number of days during the year.

Therefore, it is desirable to provide a game which would provide the vicarious thrill of deer hunting throughout the year.

It is also desirable to have such a game in the form of a card game which is easily transportable and does not require an elaborate game board or playing pieces.

It is the object of the present invention to provide a card game that accurately depicts the sport of deer hunting, including the difficulty of locating, shooting and bagging a record size buck.

SUMMARY OF THE INVENTION

A card game that accurately simulates the sport of deer hunting is comprised of a deck of cards having indicia printed on the face of each card.

In accordance with one aspect of the invention, a number of the cards are buck cards that indicate the weight and antler size of a male deer and including a comparison of the buck with a regional record for such an animal.

In accordance with yet another aspect of the invention, a number of the cards are designated as shot cards which indicate the number of shots a hunter may take.

In accordance with still another aspect of the invention, a number of the cards are designated as problem cards which indicate various difficult situations that may be encountered by a hunter in the field.

In accordance with still another aspect of the invention, a number of the cards are designated as remedy cards which are utilized to eliminate the problem cards.

Various other indicia on the cards depict the difficulty of a shot, the results of shots taken, the tracking of a wounded animal and the possibility of animal bolting.

The present invention thus provides a card game that accurately depicts the sport of deer hunting and the difficulty of locating, shooting and bagging a record size buck.

BRIEF DESCRIPTION OF THE DRAWINGS

The drawings illustrate the best mode presently contemplated of carrying out the present invention.

In the drawings.

DETAILED DESCRIPTION OF THE INVENTION

Figure 1:
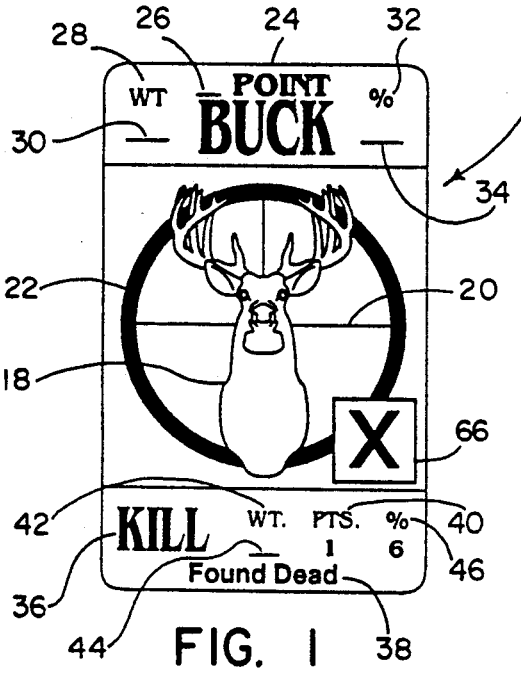
FIG. 1 illustrates the face of a wild game card utilized in a card game played according to the present invention.
Figure 2:
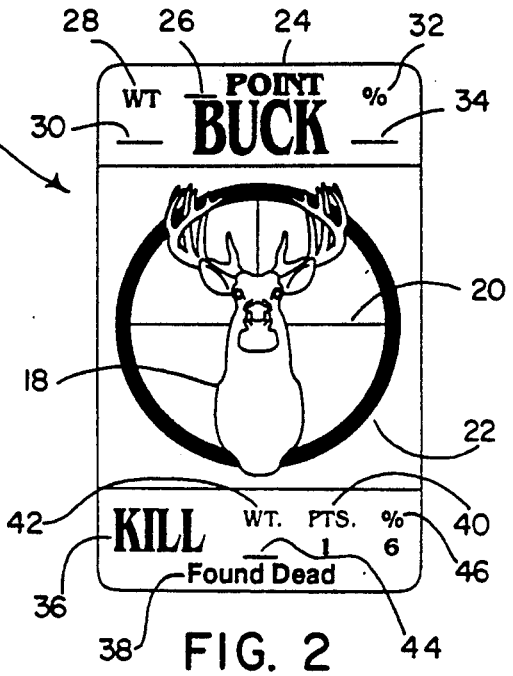
FIG. 2 illustrates the face of an alternate embodiment of the wild game card of FIG. 1.
Figure 3:
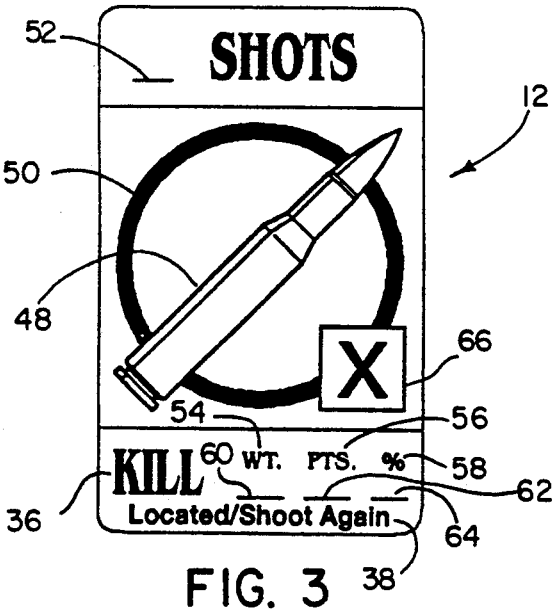
FIG. 3 illustrates the face of a shot card utilized in the game.
Figure 4:
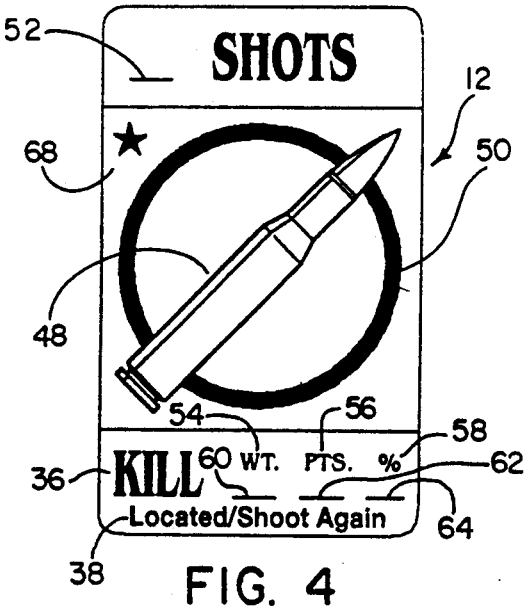
FIG. 4 illustrates the face of an alternate embodiment of the shot card of FIG. 3.
Figure 5:
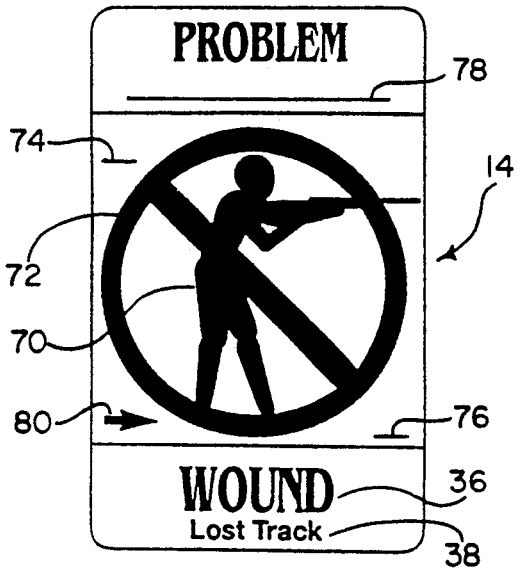
FIG. 5 illustrates the face of a problem card utilized in the card game.
Figure 6:
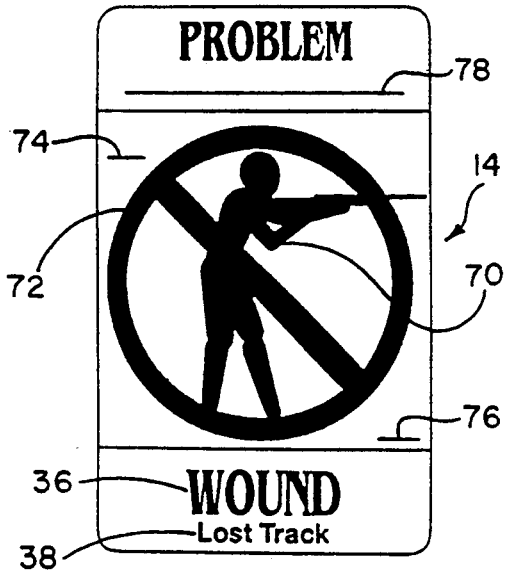
FIG. 6 illustrates the face of an alternate embodiment of the problem card of FIG. 5.
Figure 7:
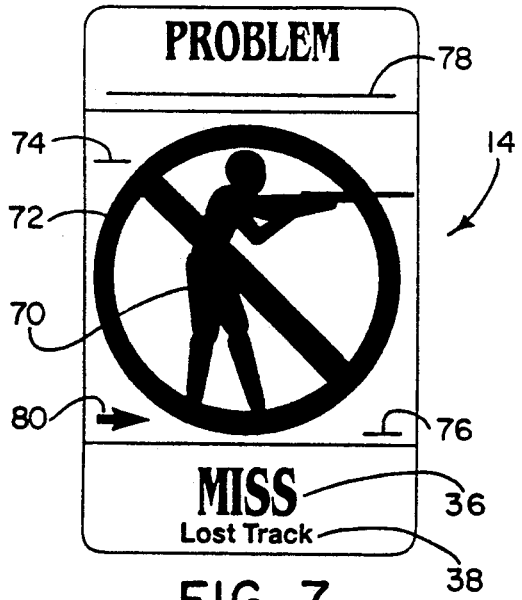
FIG. 7 illustrates the face of an alternate embodiment of the problem card of FIG. 5.
Figure 8:
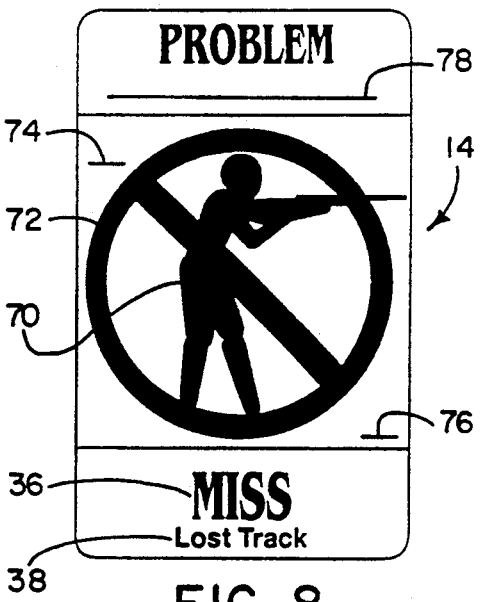
FIG. 8 illustrates the face of an alternate embodiment of the problem card of FIG. 5.
Figure 9:
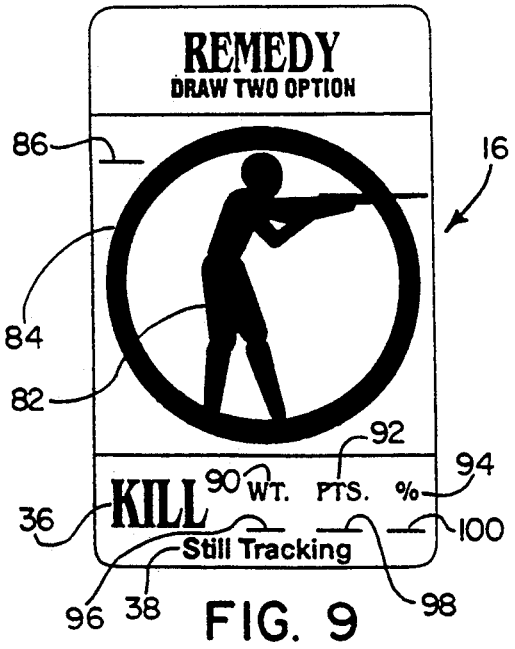
FIG. 9 illustrates the face of a remedy card utilized in the card game.
Figure 10:
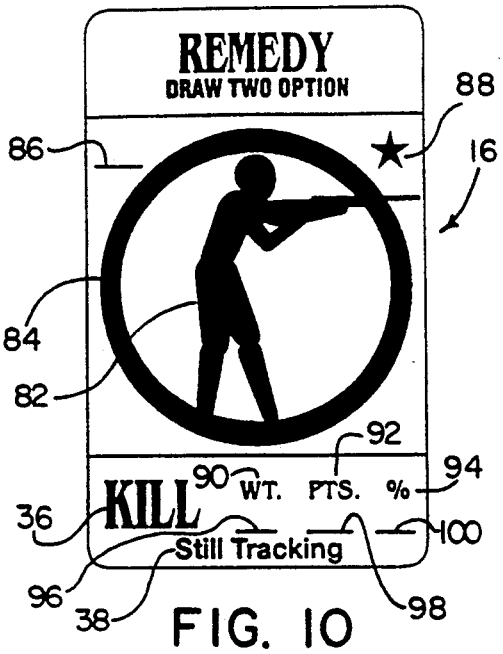
FIG. 10 illustrates the face of an alternate embodiment of the remedy card of FIG. 9.

A card game simulating the sport of hunting is comprised of a deck of cards having indicia printed on the face of each card. While the number of cards in the deck can obviously be varied, the preferred embodiment comprises a deck of seventy-two cards. In this deck, there are twenty-four wild game or buck cards 10 such as shown in FIG. 1 and FIG. 2, twelve shot cards 12 such as shown in FIGS. 3 and 4, twenty-four problem cards 14 such as shown in FIGS. 5–8 and twelve remedy cards 16 such as shown in FIG. 9 and FIG. 10.

The indicia on the face of wild game or buck cards 10 includes a centrally located buck deer 18 disposed within the crosshairs 20 of a rifle scope 22.

The upper portion of wild game or buck cards 10 includes information relating to the size of the buck. This information includes Point indicia 24. On the actual playing card, the blank 26 preceding the word "Point" will contain a number in the range of two to four. The size information at the top of buck card 10 further includes weight indicia 28. On the actual playing card, the blank 30 below weight indicia 28 will include a number in the range of four to fifty pounds. Finally, the size information includes a percentage indicia 32. On the actual playing card, blank 34 below percentage indicia 32 will include a number in the range from four to twenty-five. The percentage number is utilized to compare the size of the hunted buck deer to a regional record for a buck deer.

The bottom portion of buck cards 10 includes indicia 36 relating to the result of a shot taken by a hunter. For the twenty-four buck cards 10, shot result indicia 36 is the term "Kill". The bottom of buck cards 10 also includes tracking information 38 which relates to the result of tracking a wounded animal. For the twenty-four buck cards 10, tracking information 38 is the phrase "Found Dead".

Finally, the bottom portion of buck cards 10 includes size information identical too that contained on the upper portion of buck card 10. The use of these size indicia will be discussed in the description of the rules and play of the game. The size indicia at the bottom of buck card 10 includes point indicia 40. While the cards in FIGS. 1 and 2 show a point value of one, the actual cards will include a point range from minus one to plus one.

The size indicia at the bottom of buck cards 10 further includes weight indicia 42. On the actual buck cards 10, blank 44 will include a number in the range of minus twenty to plus twenty.

Finally, the size indicia at the bottom of buck cards 10 includes a percentage 46. While buck cards 10 in FIG. 1 and FIG. 2 have a percentage number of "6", the actual cards will include a number between zero and six.

As shown in FIG. 3 and FIG. 4, shot cards 12 include a centrally located illustration of a rifle shell 48 disposed within a circle 50.

The upper portion of shot card 12 includes indicia relating to the number of shots that may be taken by the hunter. On the actual shot card 12, blank 52 before the words "Shots" will include a number between one and four.

The bottom of shot cards 12 also includes shot result information 36 and tracking information 38. The shot result information 36 on the twelve shot cards 12 is the term "Kill". The tracking information 38 on the twelve shot cards 12 is the phrase "Located/Shoot Again". The bottom of shot cards 12 further includes size information in the form of weight 54, points 56 and percentage 58. In the actual cards, blank 60 below weight 54 will include a number between minus thirty-six and plus thirty-six. Blank 62 below points 56 will include a number between minus three and plus three and blank 64 below percentage 58 will include a number between minus three and plus three.

Both buck cards 10 and shot cards 12 may include shot difficultly indicia 66 inn the form of a bold "X" located in the lower righthand portion of the card. The relevance of this indicia will be discussed in the description of the rules and play of the game.

Shot card 12 may also include a special indicia in the upper lefthand corner in the form of a star 68. The relevance of this indicia will also be discussed in the portion of this application that discusses the rules and play of the game.

FIGS. 5-8 illustrate various forms for problem cards 14. Problem cards 14 include a centrally located illustration of a hunter 70 disposed within a circular international "Prohibited" signal 72. A blank 74 is disposed in the upper lefthand corner of the central portion of problem card 14 and on the actual problem card 14 the blank will contain either a "P" for "Preventable", an "E" for "Environmental" or an "N" for "Non-Controllable".

Another blank 76 is located in the lower righthand corner of the central portion of problem card 14 and on the actual cards this blank will include a number between one and six.

The upper portion of problem card 14 describes the type of problem encountered by the hunter. The problem is described in blank 78 which on the actual card will include one of the following phrases: "Gunshots in Area", "Other Hunters in Area", Misc. Vehicle Noises", "Other Deer in Area", "Pets in Area", Animals/Birds in Area", "Major Wind Problems", "Precipitation Problems", "Visual Problems", "Temperature Problems", "Minor Wind Problems", "Body Odor", "Sick - Need Medication", "Nature Call", "Physical/-Mental Fatigue", "Excessive Movement", "Eating/-Drinking", "Misplaced Equipment", "Equipment Failure", or "Equipment Noise".

The bottom portion of problem cards 14 also includes shot result information 36. On shot cards 14, shot result information 36 is either of the terms "Wound" or "Miss".

The bottom portion of problem card 14 also includes tracking information 38 in the form of "Lost Track" for all twenty-four problem cards 14.

Problem cards 14 may also include indicia in the form of an arrow 80 pointing either to the right or to the left. The relevance of this indicia will also be described later in the application.

FIGS. 9 and 10 illustrate remedy cards 16. Remedy cards 16 include a centrally disposed illustration of a hunter 82 disposed within a circle 84.

On the actual cards, blank 86 in the upper lefthand corner of the central portion of remedy card 16 will contain one of the following: "All", "N Only", "E Only", or "P Only". The remedy card 16 may also include a star 88 disposed in the upper righthand corner of the central portion of card 16. The relevance of this indicia will be discussed below.

The upper portion of remedy card 16 states "Remedy Draw 2 Option".

The bottom portion of remedy card 16 includes shot result information 36 in the form of "Kill" for all twelve remedy cards and tracking information 38 in the form of "Still Tracking" for all twelve remedy cards.

The bottom portion of remedy card 16 also includes size information in the form of "WT." 90, "PTS." 92 and "%" 94. In the actual cards, blank 96 below "WT." 90 will contain a number between minus eighteen and plus eighteen, blank 98 below "PTS." 92 will contain a number between minus six and plus six and blank 100 below "%" 94 will contain a number between minus three and plus three.

The above-described buck cards 10, shot cards 12, problem cards 14 and remedy cards 16 may be utilized to play the card game of the invention at either a basic or advanced level.

At the basic level, a set or hand of five cards is dealt to each player. While a player may elect to have less than five cards during the course of the game, he may at no time have more than five cards.

The remaining cards form a draw pile which is placed face down. The game is played with all of the players' cards in full view of the other players.

After receiving his set or hand of cards, the player sorts his cards according to type. As concerns buck cards 10, a player is not allowed more than four of these cards. In collecting buck cards 10, the player will attempt to collect the best possible combination of size values. In determining the weight of the buck, the values in weight blank 30 at the top of each buck card 10 are totaled and one hundred pounds is added to this number. The point values 26 and the percentage values 34 at the top of each buck card 10 are also totaled. A percentage value total of 100% is the equivalent of a new North American record for a buck. Any percentage value of 80% or greater is considered record book size.

In order to play a shot card 12, a player must have accumulated buck cards 10 with a total antler point value 26 of eight or more. A player may not shoot at a buck without a shot card 12 in his set of five or less cards.

Problem cards 14 prevent a player from utilizing a shot card. A player must always accept a problem card 14 when one is drawn from the draw pile. If a player already has a problem card 14 and draws an additional problem card 14 during his turn, he must keep the new problem card 14 and discard the old problem card 14. If a player does not have room in his set of cards for a problem card 14, he must discard a shot card 12 or a remedy card 16. A player is never allowed to reduce antler point size 26 of a buck. Therefore, he is not allowed to discard a buck card 10 in order to make room for a problem card 14.

Remedy card 16 removes problem cards 14 and thus are always discarded along with them. For example, a player already possessing a problem card 14 draws a remedy card 16. The player may then immediately discard both problem card 14 and remedy card 16. If a player was already in possession of a remedy card 16 and then drew a problem card 14, he would immediately discard both cards. Remedy cards 16 also have a "Draw Two Option". The player may elect this option by declaring to the other players before drawing any cards that he is going to utilize the "Draw Two Option". The player then discards his remedy/Draw Two Option card 16 and draws a first card. If the player does not need the first card, he may draw a second card. However, if the second card drawn is a problem card 14, the player must accept it.

When all of the cards in the draw pile have been exhausted, day one of the hunt is concluded. Since hunters are typically best prepared on the opening day of the hunt, each player may discard all of his problem cards 14 that have been dealt to him onto the discard pile. Players having more than one shot card 12 dealt to them on the first hand must discard the others.

Briefly summarizing, three conditions must be met before a player can shoot at a buck:

1. The player's buck cards 10 must add up to at least eight antler points 26.
2. The player must have a shot card 12.
3. The player must not have any problem cards 14.

Having met all three of these conditions, the player may shoot on his next turn by declaring to the other players before drawing any cards that he is going to shoot. The player then draws cards one at a time from the draw pile for each of the shots 52 stated on shot card 12. The shot results 36 are then checked. If the player draws a card reading "Kill" for shot result 36, he does not draw the remaining cards he is entitled to since he has bagged his buck. The player then discards his shot card 12, keeps his "Kill" card and all of his buck cards 10 for scoring his buck. These cards are removed from the deck and are not utilized for the rest of the game. The player has successfully killed a buck, but he is now out of the game for the remaining days of the hunt.

If all of the cards a player was entitled to draw read "Miss", the player has missed his buck and must put all of his cards on the discard pile. On his next turn, the player may resume playing the game by drawing one card.

If the player has taken all of the cards he was entitled to and has not drawn a "Kill" card, but has drawn at least one "Wound" card, the player has wounded his buck. The player maintains all of his cards and begins "Tracking".

The player tracks his buck by continuing on his next turn to draw one card and to read the tracking information 38. If tracking information 38 states "Lost Track", all of the player's cards must be put on the discard pile and the player may resume playing by drawing one card on his next turn.

If tracking information 38 indicates "Still Tracking", the player has not yet found his wounded buck, but will continue tracking by drawing another card on his next turn.

If shot information 38 indicates "Located/Shoot Again", the player may draw as many cards as stated at the top of his shot card 12. Again there will be only one of three results: "Kill", "Miss", or "Wound".

If tracking information 38 indicates "Found Dead", the player has successfully tracked the wounded buck and found him dead. The player discards his shot card 12, keeps all of his buck cards 10 and the card marked "Found Dead". These cards are removed from the deck for the rest of the game. The player then adds up the information across the top of his buck cards 10 as described above. This information is then supplemented by adding or subtracting the size values located at the bottom of the card marked "Kill" or "Found Dead". These values are final additions or deductions to the player's score. Once all of these figures have been combined, the player has his final score.

As mentioned above, when the draw pile is depleted, the first day of hunting is over. At that time, no more shots may be taken and all remaining players must discard all of their cards. The remaining cards are then shuffled and a new hand or set is dealt to each player. The game continues in this manner until the draw pile has been depleted five times (five hunting days) or when all players have killed a buck. The winner is the player who has killed a buck with the highest total percentage 34.

In the advanced level of the game, if two or more of the player's buck cards 10 include an "X" 66, the player is deemed to have a difficult shot. In this situation, a shot may be taken only with a shot card 12 that also includes an "X" 66.

In the advanced level, a shot card 12 having a star 68 may be utilized to shoot at a buck even if the player has a problem card 14. The shot card 12 containing the star 68 must be played immediately upon drawing it. Otherwise, it functions as a regular shot card. A shot card 12 having an "X" 66 may be used to shoot at any buck regardless of whether or not the buck card 10 contains an "X" 66.

In the advanced level, the notation in blank 74 on problem cards 14 is utilized. As discussed above, blank 74 may contain a "P" for Preventable, an "E" for Environmental or an "N" for Non-Controllable. The elimination of a problem card 14 now requires the use of a remedy card 16 having the same letter in blank 86. Thus, there are three different types of problem cards which a player may have to accept and therefore, he may have to discard more of his valuable cards than he wants to. If a player has nothing left to discard but buck cards 10, he must accept a problem card and it is deemed that his buck has "bolted". The problem cards now also have point values in blank 76 and if a player's problem card point total reaches ten or more, his buck has also "bolted". If a player's buck "bolts", he has gone to the next player in the direction of arrow 80 on the last drawn problem card 14. On that player's immediate next turn, he may take a shot at the other player's buck if he desires to do so and if he has a shot card 12 bearing an "X" 66. If the player misses the shot, all of his cards and the "bolting" buck cards 10 must be discarded. If the player to whom a "bolting" buck would be assigned has already killed a buck or if there is no arrow 80 on the most recently drawn problem card 14, the buck is deemed to have bolted into the discard pile.

In the advanced version of the card game, the designations in blank 86 or remedy cards 16 is now utilized. Each remedy card 16 is marked to show the type of problem card 14 it will remove, i.e. "P", "E", or "N". A remedy card 16 marked "All" may be used to remove all problem cards 14 on a single turn. A remedy card with a star 88 on it may be used for both functions, i.e. removing problem cards 14 and allowing the player to draw up to two additional cards, but this must be done immediately upon the drawing of such a remedy card 16 by a player. Otherwise, the remedy card 16 with a star 88 functions as a regular remedy card.

These additional challenges of the advanced version of the game enhance the adventure of the simulated deer hunt. Various modes of carrying out the invention are contemplated as being within the scope of the following claims particularly pointing out and distinctly claiming the subject matter regarded as the invention.

I claim:

1. A card game simulating the sport of hunting comprising:

a deck of cards having indicia printed on the face of each card, said deck including, a plurality of wild game cards indicating the type of animal being hunted, a plurality of shot cards indicating the number of shots a hunter may take, a plurality of problem cards indicating difficult situations that may be encountered by a hunter, and a plurality of remedy cards for elimination of said problem cards.

2. The card game defined in claim 1 wherein said wild game cards indicate a male deer and further include indicia relating to weight and antler size of said deer.

3. The card game defined in claim 1 wherein said wild game cards further include indicia comparing said hunted animal to a regional record for such an animal.

4. The card game defined in claim 1 wherein at least some of said wild game cards further include indicia relating to the difficulty of the shot being taken by the hunter.

5. The card game defined in claim 1 wherein at least some of said shot cards further include indicia relating to the difficulty of the shot being taken by the hunter.

6. The card game defined in claim 1 wherein at least some of said shot cards and remedy cards include indicia relating to the weight and antler size of a male deer.

7. The card game defined in claim 1 wherein at least some of said shot cards and remedy cards include indicia comparing said hunted animal to a regional record for such an animal.

8. The card game defined in claim 1 wherein at least some of said wild game cards, shot cards, problem cards and remedy cards include indicia relating to the result of a shot taken by a hunter.

9. The card game defined in claim 1 wherein at least some of said wild game cards, shot cards, problem cards and remedy cards include indicia relating to the tracking of a wounded animal.

10. The card game defined in claim 1 wherein each of said problem cards include indicia relating to a point value for said problem card.

11. The card game defined in claim 1 wherein at least some of said problem cards include indicia relating to the results of a bolting animal.

12. A card game simulating the sport of hunting comprising:

a deck of cards having indicia printed on the face of each card, said deck including, a plurality of buck cards indicating the weight and antler size of a male deer and a comparison of said buck with a regional record for such an animal, a plurality of shot cards indicating the number of shots a hunter may take and indicating the weight and antler size of a male deer and a comparison of said buck with a regional record for such an animal, a plurality of problem cards indicating difficult situations that may be encountered by a hunter, and a plurality of remedy cards for elimination of said problem cards indicating the weight and antler size of a male deer and a comparison of said buck with a regional record for such an animal.

13. A method of playing a card game simulating the sport of hunting and utilizing a deck of cards including, a plurality of wild game cards indicating the type and size of the animal being hunted, a plurality of shot cards indicating the number of shots a hunter may take, a plurality of problem cards indicating difficult situations that may be encountered by a hunter, and a plurality of remedy cards for elimination of said problem cards, said method comprising the steps of:

dealing a set of cards to a plurality of players and forming a draw pile, starting a discard pile by allowing players to discard a card after drawing a card from the draw pile as their playing turn comes around, establishing a minimum for said animal size before said animal may be shot, each player selecting a card from the draw pile as their turn comes around in order to collect a plurality of wild game cards whose total of size indicia exceeds said minimum and to obtain a shot card permitting the player to fire at least one shot, allowing a player to play a shot card only if his set of cards is devoid of a problem card, allowing a player to discard a problem card only if he is in possession of a remedy card, continuing to play the game in a turn fashion until each player has successfully shot an animal whose size exceeds said minimum or until said draw pile has been exhausted a predetermined number of times.

14. The method of playing a game according to claim 13 wherein, at least some of said wild game cards, shot cards, problem cards and remedy cards include indicia relating to the result of a shot taken by a hunter including a kill indicia and requiring a player to select at least one additional card from the draw pile after the play of a shot card and allowing said player to claim a kill only upon selecting a card having a kill indicia.

15. The method of playing a game according to claim 13 wherein at least some of said wild game cards, shot cards and remedy cards include indicia comparing said hunted animal to a regional record for such an animal and the step of determining a winner of the game by totaling said comparison indicia of each player who has claimed a kill.

* * * * *